US011345520B2

(12) United States Patent
Irwin

(10) Patent No.: US 11,345,520 B2
(45) Date of Patent: May 31, 2022

(54) LOCKING ASSEMBLY FOR RELEASABLY-LOCKING A LID TO A CONTAINER

(71) Applicant: KacePack Ltd., Sheung Wan (HK)

(72) Inventor: George Douglas Irwin, Sheung Wan (HK)

(73) Assignee: KacePack Ltd., Sheung Wan (HK)

( * ) Notice: Subject to any disclaimer, the term of this patent is extended or adjusted under 35 U.S.C. 154(b) by 0 days.

(21) Appl. No.: 17/263,877

(22) PCT Filed: Jan. 15, 2019

(86) PCT No.: PCT/CN2019/071708
§ 371 (c)(1),
(2) Date: Jan. 27, 2021

(87) PCT Pub. No.: WO2020/019690
PCT Pub. Date: Jan. 30, 2020

(65) Prior Publication Data

US 2021/0300636 A1 Sep. 30, 2021

(30) Foreign Application Priority Data

Jul. 27, 2018 (HK) ..... 18109773.4

(51) Int. Cl.
*B65D 43/12* (2006.01)
*B65D 50/04* (2006.01)

(52) U.S. Cl.
CPC ..... *B65D 43/12* (2013.01); *B65D 50/046* (2013.01); *B65D 2215/02* (2013.01)

(58) Field of Classification Search
CPC ..... B65D 45/16; B65D 50/046; B65D 43/12; B65D 43/02; B65D 43/20; B65D 45/22; B65D 50/045; B65D 50/04
(Continued)

(56) References Cited

U.S. PATENT DOCUMENTS 2,086,534 A * 7/1937 Byrne ..... B65D 43/14 220/811
3,782,584 A * 1/1974 Swenson ..... B65D 43/12 220/345.3
(Continued)

FOREIGN PATENT DOCUMENTS

CN 2431234 Y 5/2001
CN 202022417 U 11/2011
(Continued)

OTHER PUBLICATIONS

Feng, Chao, Authorized Officer, National Intellectual Property Administration, PRC, "International Search Report" in connection with related International Application No. PCT/CN2019/071708, dated Apr. 30, 2019, 4 pgs.
(Continued)

*Primary Examiner* — Robert J Hicks
(74) *Attorney, Agent, or Firm* — Bookoff McAndrews, PLLC

(57) ABSTRACT

A locking assembly for releasably-locking a lid to a container includes: shaped portions disposed on the lid and container that are configured to allow slidable engagement of the lid relative to the container along a movement axis. A locking nub disposed on a wall of the container and a nub receiving portion disposed on the lid are engaged when the lid and container are slidably engaged together, which restricts sliding movement of the lid relative to the container along the movement axis The wall of the container is inwardly depressible to move the locking nub outwardly of the nub receiving portion, which allows slidable movement relative to the container along the movement axis.

19 Claims, 2 Drawing Sheets

(58) Field of Classification Search
USPC ..... 220/200, 812, 811, 810, 326, 324; 206/1.5
See application file for complete search history.

(56) References Cited

U.S. PATENT DOCUMENTS

| | | | | |
|---|---|---|---|---|
| 3,888,350 | A * | 6/1975 | Horvath | B65D 50/045 206/531 |
| 4,113,098 | A * | 9/1978 | Howard | A61J 1/03 206/1.5 |
| 4,126,224 | A * | 11/1978 | Laauwe | B65D 50/06 206/540 |
| 4,561,544 | A * | 12/1985 | Reeve | B65D 11/12 206/1.5 |
| 4,946,057 | A * | 8/1990 | Connolly | B65D 25/22 206/45.28 |
| 5,080,222 | A * | 1/1992 | McNary | B65D 50/045 206/1.5 |
| 5,082,137 | A * | 1/1992 | Weinstein | B65D 43/20 206/1.5 |
| 7,140,511 | B2 * | 11/2006 | Baker | B65D 43/20 220/813 |
| 7,275,642 | B2 * | 10/2007 | Yuhara | A45D 40/22 206/1.5 |
| 7,708,142 | B2 * | 5/2010 | Ehrlund | B65D 5/38 206/528 |
| 7,757,843 | B2 * | 7/2010 | Katsis | A24F 27/00 206/1.5 |
| 8,657,136 | B2 * | 2/2014 | Adler | B65D 43/20 215/201 |
| 9,346,594 | B2 * | 5/2016 | Pipes | B65D 50/066 |
| 9,924,834 | B2 | 3/2018 | Joffe | |
| 9,938,042 | B1 * | 4/2018 | Aryanpanah | B65D 50/04 |
| 9,981,788 | B2 * | 5/2018 | Skinner | B65D 50/046 |
| 2004/0055903 | A1 * | 3/2004 | Nishimura | B65D 83/08 206/1.5 |
| 2007/0164032 | A1 * | 7/2007 | Cronin | B65D 43/12 220/345.1 |
| 2007/0284277 | A1 * | 12/2007 | Gnepper | B65D 11/12 206/528 |
| 2009/0152134 | A1 * | 6/2009 | Katsis | A24F 27/00 206/96 |
| 2010/0038278 | A1 * | 2/2010 | Gattefosse | B65D 50/046 206/531 |
| 2018/0305092 | A1 * | 10/2018 | Lucas, Jr. | A61J 1/03 |
| 2021/0253315 | A1 * | 8/2021 | Fortuny Cuadra | F24F 5/0021 |

FOREIGN PATENT DOCUMENTS

| | | | |
|---|---|---|---|
| CN | 203318926 | U | 12/2013 |
| CN | 203450531 | U | 2/2014 |
| CN | 207060798 | U | 3/2018 |
| CN | 207450641 | U | 6/2018 |
| EP | 2799364 | A1 | 11/2014 |

OTHER PUBLICATIONS

Feng, Chao, Authorized Officer, National Intellectual Property Administration, PRC, "Written Opinion of the International Searching Authority" in connection with related International Application No. PCT/CN2019/071708, dated Apr. 30, 2019, 3 pgs.
Evaluation Report of Utility Model Patent completed Feb. 7, 2022 in Chinese Application No. CN201990001025.X (6 pages).

* cited by examiner

LOCKING ASSEMBLY FOR RELEASABLY-LOCKING A LID TO A CONTAINER

TECHNICAL FIELD

The present invention relates to a locking mechanisms for containers including for instance child-safe locks.

BACKGROUND OF THE INVENTION

Certain food products, cleaning agents, medications and the like that are commonly found in the home may be dangerous to young children. Such substances must be transported and stored in containers having "child-safe" locking mechanisms for locking the lid of the container and which are difficult for children to open by means of challenging their cognition, dexterity and/or strength. Currently, existing child-safe locking mechanisms tend to utilise variations on one of a few common designs, such as the "push and twist" style cap. Whilst oftentimes effective, the prevalent use of this style of cap lock has become so widely used that children, of even younger ages, have become accustomed to them thus limiting their potential long-term effectiveness.

SUMMARY OF THE INVENTION

The present invention seeks to alleviate at least one of the above-described problems.

The present invention may involve several broad forms. Embodiments of the present invention may include one or any combination of the different broad forms herein described.

In a first broad form, the present invention provides a locking assembly for releasably-locking a lid to a container so that the lid covers an opening of the container, the locking assembly including: shaped portions disposed on the lid and container that are configured to allow slidable engagement of the lid relative to the container along a movement axis between a first configuration in which the lid covers the opening in to a second configuration in which the lid does not cover the opening; a locking nub disposed on a wall of the container; a nub receiving portion disposed on the lid; and wherein when the lid and container are slidably engaged together in the first configuration, the locking nub disposed on the container is received within the nub receiving portion disposed on the lid so as to restrict sliding movement of the lid relative to the container along the movement axis from the first configuration in to the second configuration, and, wherein the wall of the container is inwardly depressible so as to move the locking nub outwardly of the nub receiving portion whereby the lid is then able to be slidably moved relative to the container along the movement axis from the first configuration in to the second configuration.

Preferably, at least one of the shaped portions may form a pair of rails disposed along a rim of the container opening, and at least one of the shaped portions form rail engagement elements disposed on the lid that are configured for slidable engagement with the rails.

Preferably, the locking nubs may extend outwardly from opposing elongate sidewalls of the container along at least one axis that is transverse to the movement axis.

Preferably, the lid may include a main body configured for covering the opening of the container, and side portions extending perpendicularly from elongate side-edges of the main body.

Preferably, the side portions may each include a nub receiving portion for receiving one of the locking nubs when the lid is slidably engaged with the container in the first configuration.

Preferably, the nub receiving portion may include at least one of a slot, a recess and a rebate.

Preferably, the present invention may include a humidity control material disposed on the lid of the container.

Preferably, the container may be is formed from at least one of a tin, aluminium or polymeric material.

In another broad form, the present invention provides a locking assembly for releasably-locking a lid to a container so that the lid covers an opening of the container, the locking assembly including: shaped portions disposed on the lid and container that are configured to allow slidable engagement of the lid relative to the container along a movement axis between a first configuration in which the lid covers the opening in to a second configuration in which the lid does not cover the opening; a locking nub disposed on the lid; a nub receiving portion disposed on a wall of the container; and wherein when the lid and container are slidably engaged together in the first configuration, the locking nub disposed on the lid is received within the nub receiving portion disposed on the container so as to restrict sliding movement of the lid relative to the container along the movement axis from the first configuration in to the second configuration, and, wherein the wall of the container is inwardly depressible so that the locking nub is moved relatively outwardly of the nub receiving portion and whereby the lid is then able to be slidably moved relative to the container along the movement axis from the first configuration in to the second configuration.

BRIEF DESCRIPTION OF THE DRAWINGS

The present invention will become more fully understood from the following detailed description of a preferred but non-limiting embodiments thereof, described in connection with the accompanying drawings, wherein.

DETAILED DESCRIPTION OF THE PREFERRED EMBODIMENTS

Preferred embodiments of the present invention will now be described herein with reference to FIGS. 1 to 4. The embodiments comprise a container (10A, 10B, 10C) having a child-safe type locking mechanism for releasably locking a lid (20A) on to the container (10A, 10B, 10C) so that the lid (20A, 20B, 20C) covers an opening of the container (10A, 10B, 10C).

Figure 1A:
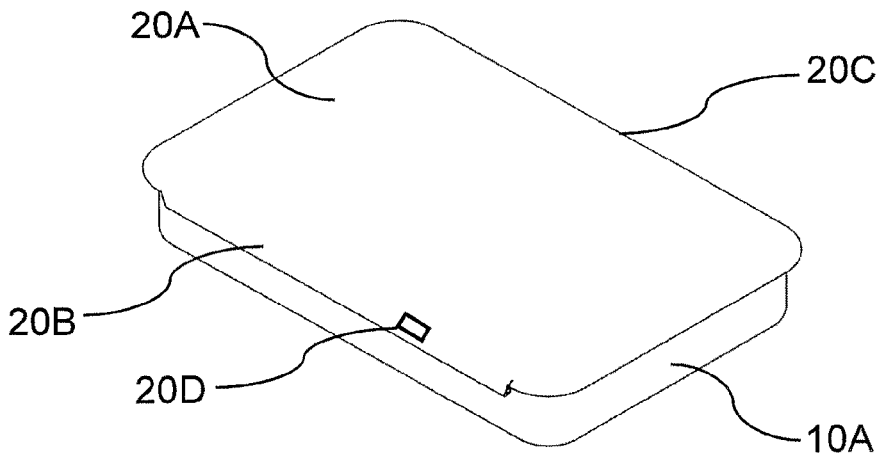
FIG. 1A shows a perspective view of a container having an opening covered by a lid in accordance with a first embodiment.
Figure 1B:
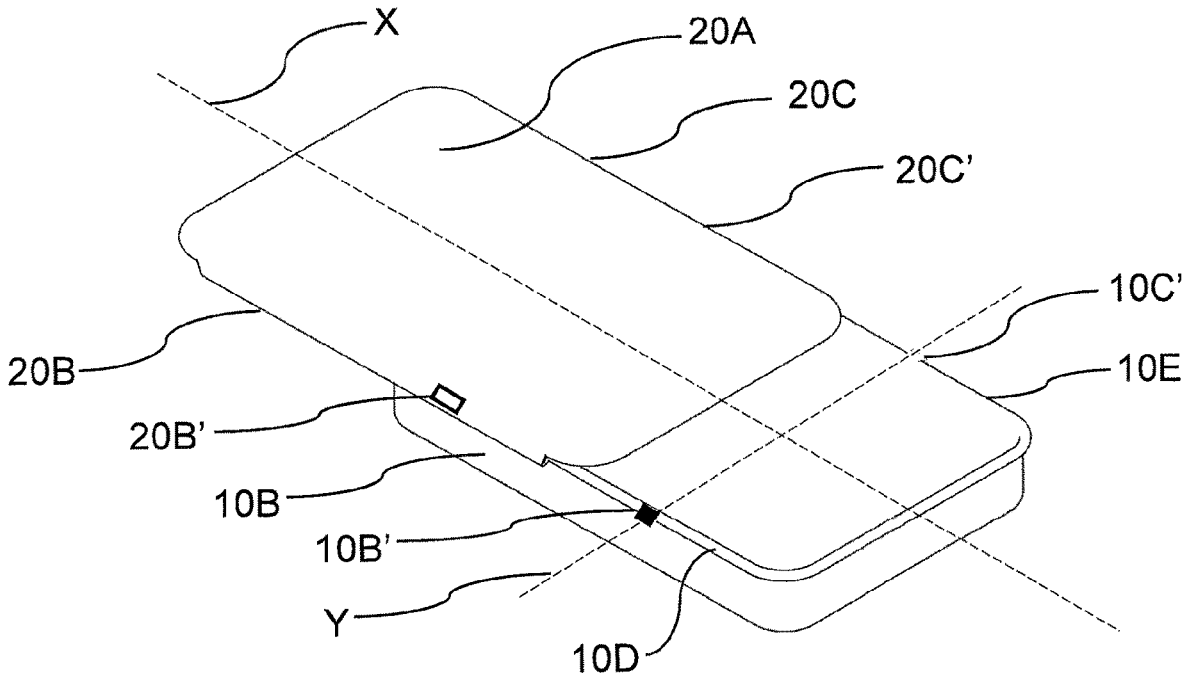
FIG. 1B shows a perspective view of the container having an opening partially covered by a lid in accordance with the first embodiment.
Figure 2:
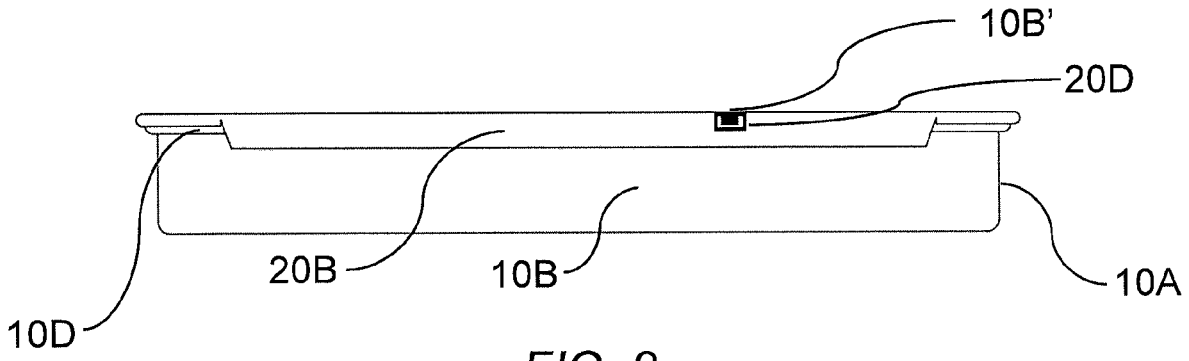
FIG. 2 shows a side-view of the container having the opening covered by the lid in accordance with the first embodiment.
Figure 3:
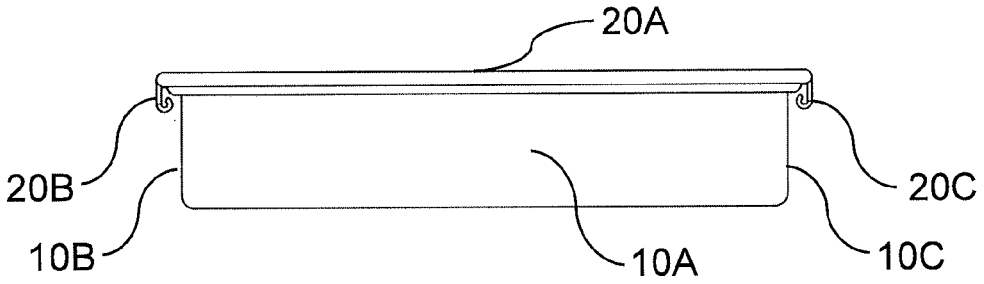
FIG. 3 shows a front-view of the container having the opening covered by the lid in accordance with the first embodiment.
Figure 4:
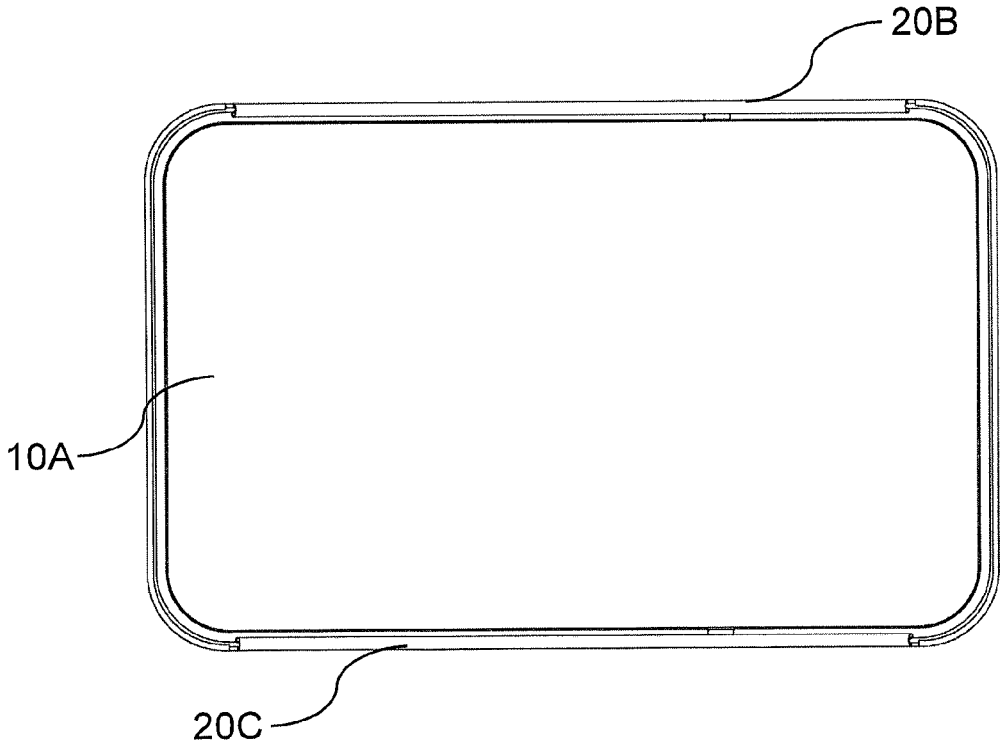
FIG. 4 shows a bottom-view of the container having the opening covered by the lid in accordance with the first embodiment.

The locking assembly includes shaped portions disposed on the lid (20A, 20B, 20C) and on the container (10A, 10B, 10C) that are configured to allow slidable engagement of the lid (20A, 20B, 20C) relative to the container (10A, 106, 10C) along a movement axis (X) between a first configuration (as shown in FIG. 1A) in which the lid covers the opening in to a second configuration (as shown in FIG. 1B) in which the lid does not cover the opening;

In this embodiment the container is substantially rectangular-shaped and includes side walls (10B, 10C). Shaped portions in the form of a pair of parallel rails (10D, 10E) are disposed along a rim of the container opening on the side walls (10B, 10C) of the container (10A, 10B, 10C). Shaped portions in the form of rail engagement elements (20B, 20C) are also disposed on the lid (20A, 20B, 20C) and are configured for slidable engagement with the parallel rails (10D, 10E).

The lid (20A, 20B, 20C) includes a main body (20A) comprises a substantially flat rectangular portion (20A) that is configured for covering the opening of the container. and side portions (20B, 20C) that extend substantially perpendicularly from elongate side-edges of the main body (20A).

The locking assembly comprises locking nubs (10B', 10C') protruding outwardly from each of the side-walls (10B, 10C) of the container along an axis (Y) which is transverse to the movement axis (X), and, locking nub receiving portions in the form of slots (20B'. 20C') that are cut out of each of the side portions (20B, 20C) of the lid. The slots (20B'. 20C') are shaped and dimensioned for snugly receiving their corresponding locking nubs. When the lid (20A, 20B, 20C) and container (10A, 10B, 10C) are slidably engaged together in the first configuration, the locking nubs (10B', 10C') disposed on the container (10A, 10B, 10C) are received within the corresponding slots (20B'. 20C') disposed on the lid (20A, 20B, 20C) so as to restrict sliding movement of the lid (20A, 20B, 20C) relative to the container along the movement axis (X) from the first configuration in to the second configuration. The wall of the container (which in this embodiment is made from tin or aluminium) is configured to be inwardly depressible by a user so as to cause movement of the locking nubs (10B', 10C)' outwardly of the slots (20B'. 20C') whereby the lid (20A, 20B, 20C) is then able to be slidably moved relative to the container (10A, 10B, 10C) along the movement axis (X) from the first configuration in to the second configuration.

In certain embodiments, the locking nubs may be disposed on the lid whilst the locking nub receiving portions may be disposed on the container in reverse fashion.

In yet further embodiments, the container may include a humidity control material. For instance such a material may be disposed on the lid of the container so as to face inwardly of the container when the lid covers the container and to control or regulate humidity within the container during use.

It would be appreciated that embodiments of the present invention as described herein require a degree of cognitive and dexterity ability to open the container which is designed to exceed the ability of young children. Further, such a solution provides added variability to its use that extends in contrast to existing methodologies for effecting child-safe locking mechanisms. Yet further, the streamlined design and relatively simplified function allows it to be applied to a wide variety of container, jars and bottles in numerous materials and sizes. Yet further, embodiments of the present invention are advantageous in that the combined lid/locking collar assembly may be pressed down in to secured engagement with the container when the combined lid/locking collar assembly is arranged in any position of coaxial rotation relative to the container thus making it easier to operate and saving time for the user.

Those skilled in the art will appreciate that the invention described herein is susceptible to variations and modifications other than those specifically described without departing from the scope of the invention. All such variations and modification which become apparent to persons skilled in the art, should be considered to fall within the spirit and scope of the invention as broadly hereinbefore described. It is to be understood that the invention includes all such variations and modifications. The invention also includes Zo all of the steps and features, referred or indicated in the specification, individually or collectively, and any and all combinations of any two or more of said steps or features.

The reference to any prior art in this specification is not, and should not be taken as, an acknowledgment or any form of suggestion that that prior art forms part of the common general knowledge.

What is claimed is:

1. A locking assembly for releasably-locking a lid to a container so that the lid covers an opening of the container, the locking assembly including:

shaped portions disposed on the lid and container that are configured to allow slidable engagement of the lid relative to the container along a movement axis between a first configuration in which the lid covers the opening in to a second configuration in which the lid does not cover the opening;

a locking nub disposed on a wall of the container;

a nub receiving portion disposed on the lid; and wherein when the lid and container are slidably engaged together in the first configuration, the locking nub disposed on the container is received within the nub receiving portion disposed on the lid so as to restrict sliding movement of the lid relative to the container along the movement axis from the first configuration in to the second configuration, and, wherein the wall of the container is inwardly depressible so as to move the locking nub outwardly of the nub receiving portion whereby the lid is then able to be slidably moved relative to the container along the movement axis from the first configuration in to the second configuration.

2. The locking assembly of claim 1, wherein at least one of the shaped portions forms a pair of rails disposed along a rim of the container opening, and at least one of the shaped portions form rail engagement elements disposed on the lid configured for slidable engagement with the rails.

3. The locking assembly of claim 1, wherein the locking nubs extend outwardly from opposing elongate sidewalls of the container along at least an axis that is transverse to the movement axis.

4. The locking assembly of claim 1, wherein the lid includes a main body configured for covering the opening of the container, and side portions extending perpendicularly from elongate side-edges of the main body.

5. The locking assembly of claim 4, wherein the side portions each include a nub receiving portion for receiving one of the locking nubs when the lid is slidably engaged with the container in the first configuration.

6. The locking assembly of claim 1, wherein the nub receiving portion includes at least one of a slot and a recess.

7. The locking assembly of claim 1, wherein the lid is configured to become engaged with the container by pressing the lid downwardly against the container.

8. The locking assembly of claim 1, further including a humidity control material configured to face inwardly of the container and to regulate humidity within the container.

9. The locking assembly of claim 1, wherein the container is substantially rectangular and the shaped portions are disposed on side walls of the container; and the lid includes a substantially flat rectangular portion configured for covering the opening of the container and side portions that extend substantially perpendicularly from the substantially flat rectangular portion.

10. A locking assembly for releasably-locking a lid to a container so that the lid covers an opening of the container, the locking assembly including:

shaped portions disposed on the lid and container that are configured to allow slidable engagement of the lid relative to the container along a movement axis between a first configuration in which the lid covers the opening in to a second configuration in which the lid does not cover the opening;

a locking nub disposed on the lid;

a nub receiving portion disposed on a wall of the container; and wherein when the lid and container are slidably engaged together in the first configuration, the locking nub disposed on the lid is received within the nub receiving portion disposed on the container so as to restrict sliding movement of the lid relative to the container along the movement axis from the first configuration in to the second configuration, and, wherein the wall of the container is inwardly depressible so that the locking nub is moved relatively outwardly of the nub receiving portion and whereby the lid is then able to be slidably moved relative to the container along the movement axis from the first configuration in to the second configuration.

11. The locking assembly of claim 10, wherein the container is formed from at least one of a tin, aluminium or polymeric material.

12. The locking assembly of claim 10, wherein at least one of the shaped portions forms a pair of rails disposed along a rim of the container opening, and at least one of the shaped portions forms rail engagement elements disposed on the lid configured for slidable engagement with the rails.

13. The locking assembly of claim 10, wherein the locking nubs extend inwardly toward opposing elongate sidewalls of the container along at least an axis that is transverse to the movement axis.

14. The locking assembly of claim 10, wherein the lid includes a main body configured for covering the opening of the container, and side portions extending perpendicularly from elongate side-edges of the main body.

15. The locking assembly of claim 14, wherein the side portions each include a locking nub that is received by one of the nub receiving portions when the lid is slidably engaged with the container in the first configuration.

16. The locking assembly of claim 10, wherein the nub receiving portion includes at least one of a slot and a recess.

17. The locking assembly of claim 10, wherein the lid is configured to become engaged with the container by pressing the lid downwardly against the container.

18. The locking assembly of claim 10, further including a humidity control material configured to face inwardly of the container and to regulate humidity within the container.

19. The locking assembly of claim 10, wherein the container is substantially rectangular and the shaped portions are disposed on side walls of the container; and the lid includes a substantially flat rectangular portion configured for covering the opening of the container and side portions that extend substantially perpendicularly from the substantially flat rectangular portion.

* * * * *